US007579536B2

(12) United States Patent
Bonebrake

(10) Patent No.: US 7,579,536 B2
(45) Date of Patent: Aug. 25, 2009

(54) TENSION EQUALIZER

(76) Inventor: Gordon Bonebrake, 1005 S. Bridge St., Baker City, OR (US) 97814-4503

( * ) Notice: Subject to any disclaimer, the term of this patent is extended or adjusted under 35 U.S.C. 154(b) by 175 days.

(21) Appl. No.: 11/753,220

(22) Filed: May 24, 2007

(65) Prior Publication Data

US 2008/0289474 A1 Nov. 27, 2008

(51) Int. Cl.
*G10D 3/14* (2006.01)

(52) U.S. Cl. ..... 84/312 R; 84/297 R

(58) Field of Classification Search ..... 84/312 R, 84/209, 214, 297 R–305
See application file for complete search history.

(56) References Cited

U.S. PATENT DOCUMENTS 2,254,012 A * 8/1941 Kudo ..... 84/455
3,695,137 A * 10/1972 Eurich ..... 84/312 R

* cited by examiner

*Primary Examiner*—Jianchun Qin
(74) *Attorney, Agent, or Firm*—Ormiston & McKinney PLLC

(57) ABSTRACT

In one embodiment, a device includes: first, second, and third paired-strand levers each configured to receive a pair of tensile strands at locations spaced apart from one another along the paired-strand lever; first, second, and third fulcrums each supporting a corresponding one of the paired-strand levers between the tensile strand receiving locations; a fourth lever linked to the first and second paired-strand levers through the first and second fulcrums, respectively, at secondary lever link locations spaced apart from one another along the fourth lever; a fourth fulcrum supporting the fourth lever between the secondary lever link locations; a fifth lever linked to the third paired-string lever and the fourth lever through the third and fourth fulcrums, respectively, at primary lever link locations spaced apart from one another along the fifth lever; and a fifth fulcrum supporting the fifth lever between the primary lever link locations.

15 Claims, 7 Drawing Sheets

TENSION EQUALIZER

BACKGROUND

Guitars and other stringed instruments are tuned by adjusting the tension in the strings. In the case of a guitar, for example, the tension in each string is adjusted individually by turning the tuning heads on the headstock of the guitar. The desired string tension is often obtained by comparing the tone of one string with the tone of another string. The strings get out of tune when the tension in one string changes relative to the tension in one or more of the other strings. One way to help keep a guitar or other stringed instrument in tune, therefore, is to maintain the same relative tension among the strings.

DRAWINGS

DETAILED DESCRIPTION

Embodiments of the new tension equalizer were developed in an effort to keep the strings on a guitar in tune. Embodiments, therefore, will be described with reference to a guitar. The new tension equalizer, however, is not limited to use with a guitar but may be used with other stringed instruments or with other devices in which it may be desirable to maintain the relative tension between strings. "String" as used in this document means a tensile strand of any kind.

Figure 1:
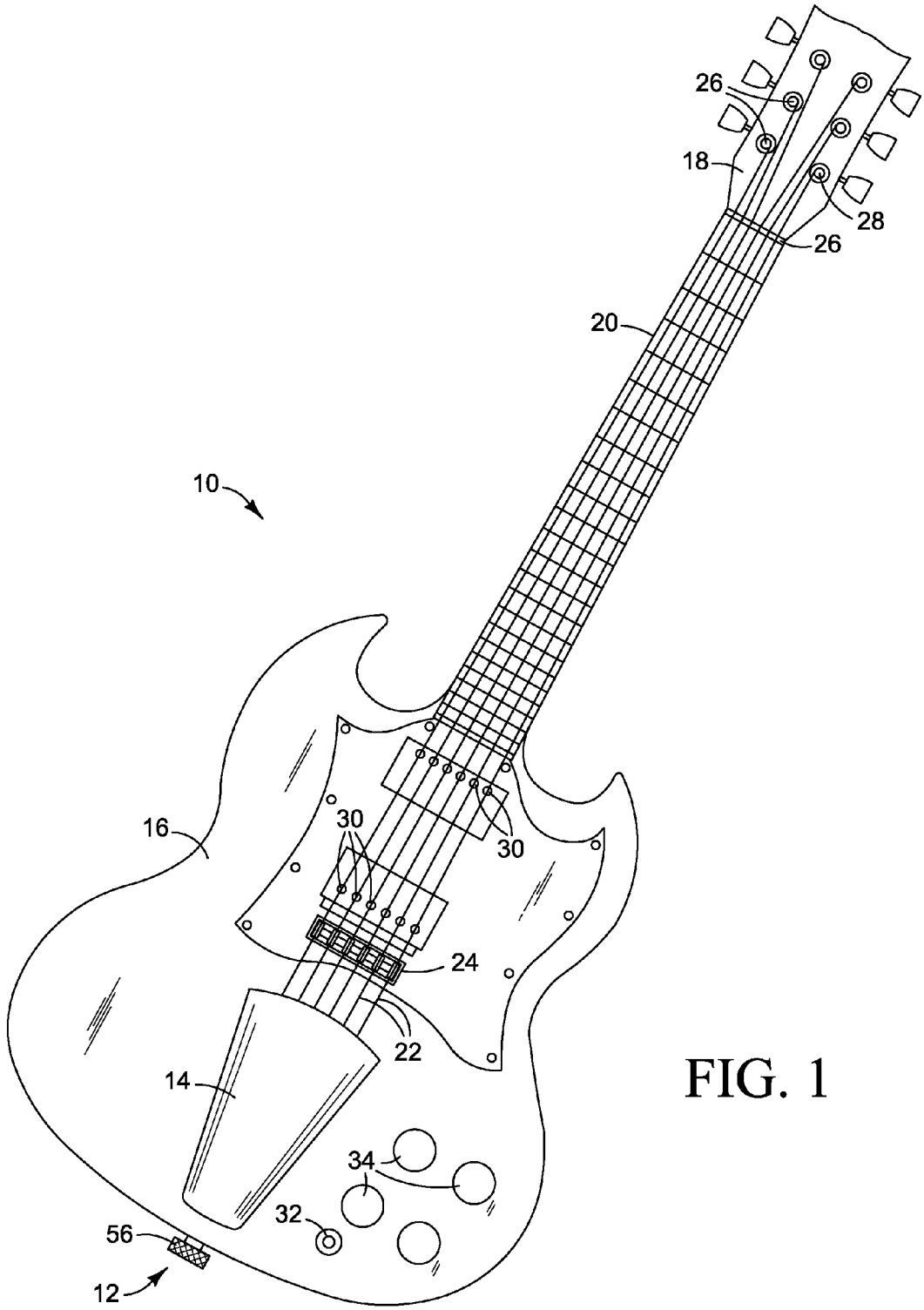
FIG. 1 is a plan view illustrating an electric guitar that includes a tension equalizer, according to one embodiment of the invention.
Figure 2:
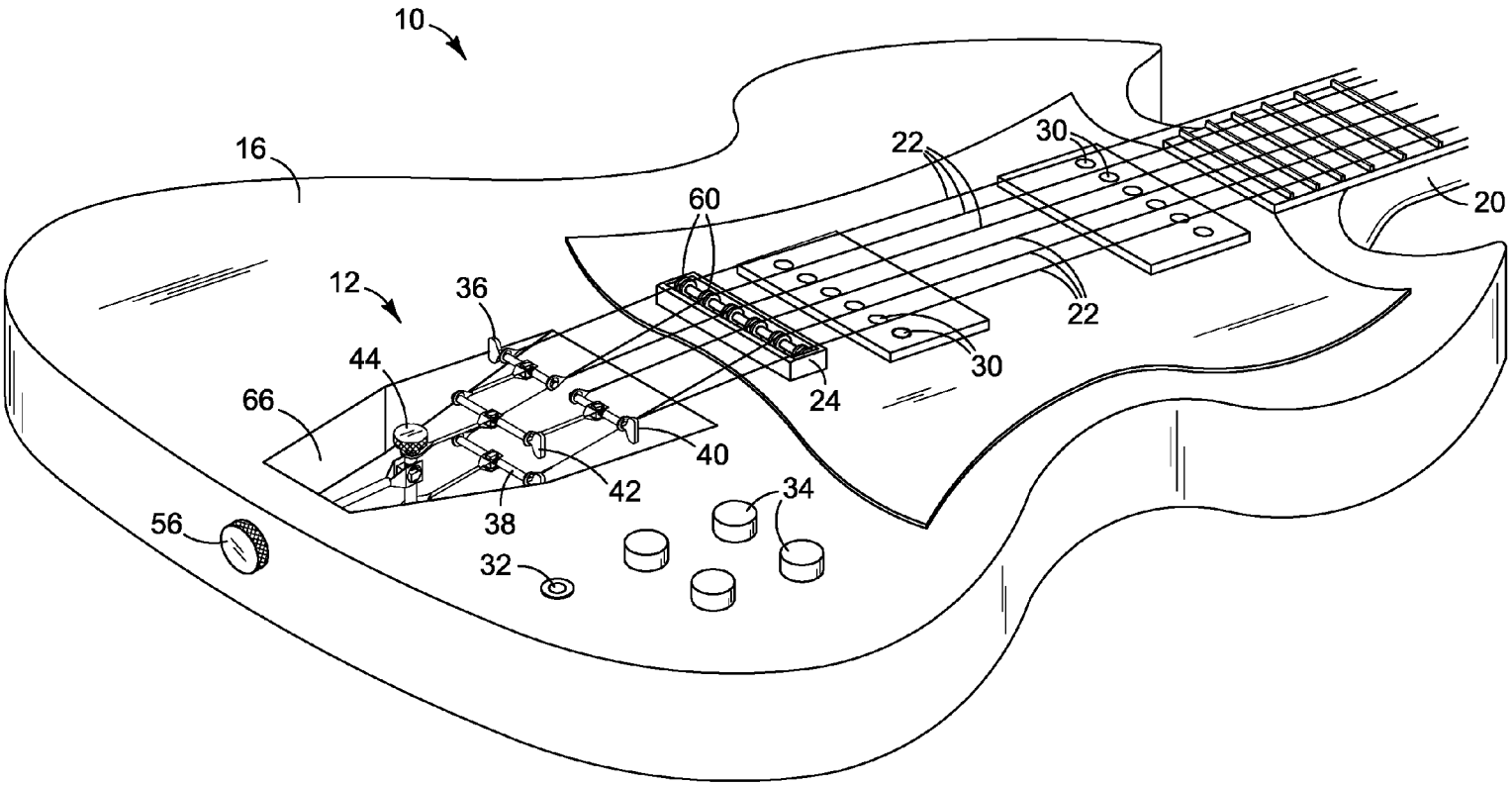
FIG. 2 is a perspective view of part of the guitar of FIG. 1 with the cover over the tension equalizer removed.

FIG. 1 is a plan view illustrating an electric guitar 10 that includes a tension equalizer 12 that is mostly hidden behind a cover 14. FIG. 2 is a perspective view of the body of guitar 10 with cover 14 removed so that tension equalizer 12 is more visible. Referring to FIGS. 1 and 2, guitar 10 includes a body 16, a headstock 18, and a neck 20 extending between body 16 and headstock 18. Each string 22 extends from tension equalizer 12 over a bridge 24, along body 16 and neck 22, over a nut 26 to a tuning head 28. Guitar 10 also includes electrical pick-ups 30, an amplifier jack 32, and adjustment/selection knobs 34.

Figure 3:
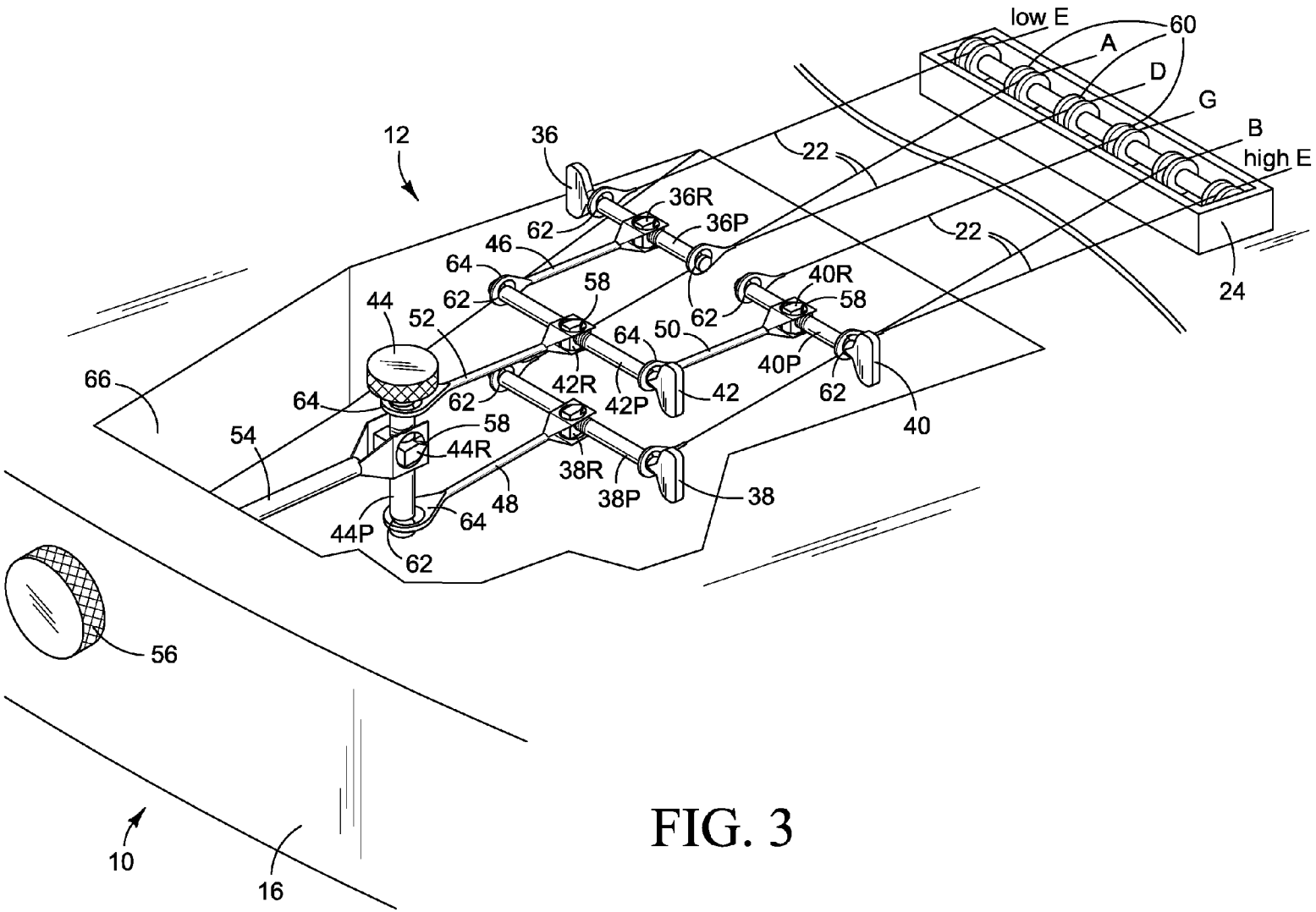
FIG. 3 is a partially cut-away perspective view of the tension equalizer on the guitar of FIGS. 1 and 2.
Figure 4:
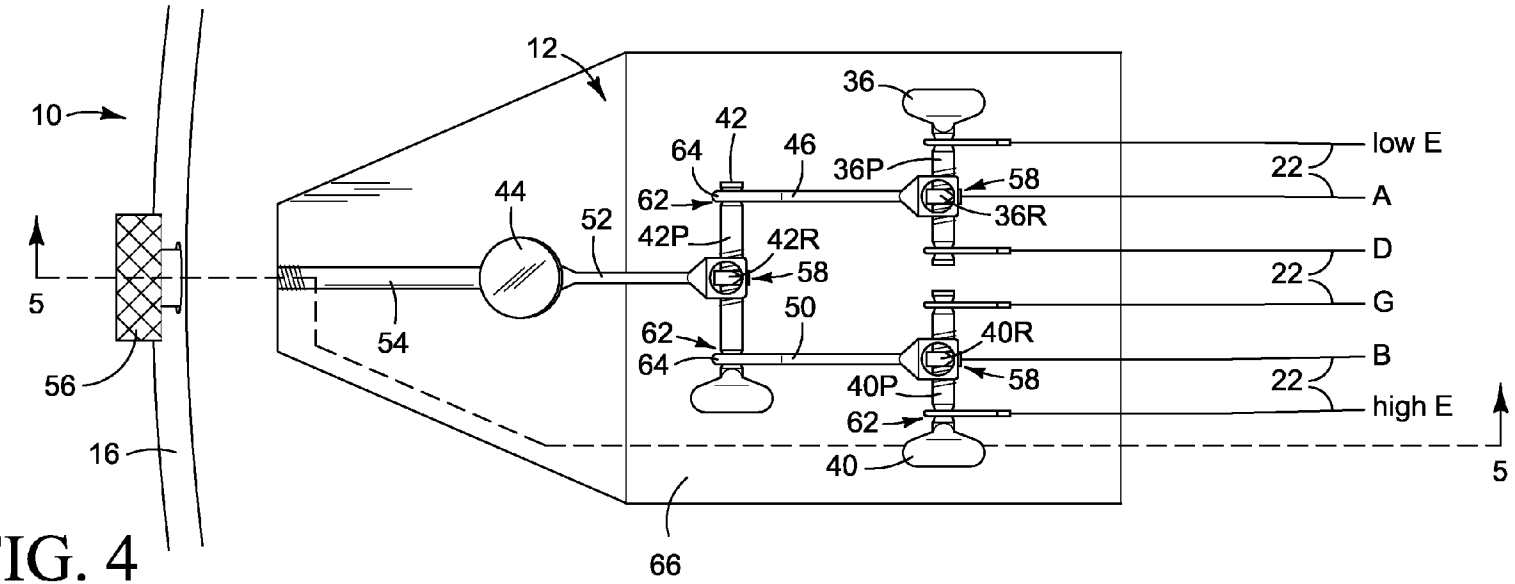
FIGS. 4 and 5 are plan and elevation views, respectively, of the tension equalizer shown in FIG. 3.
Figure 5:
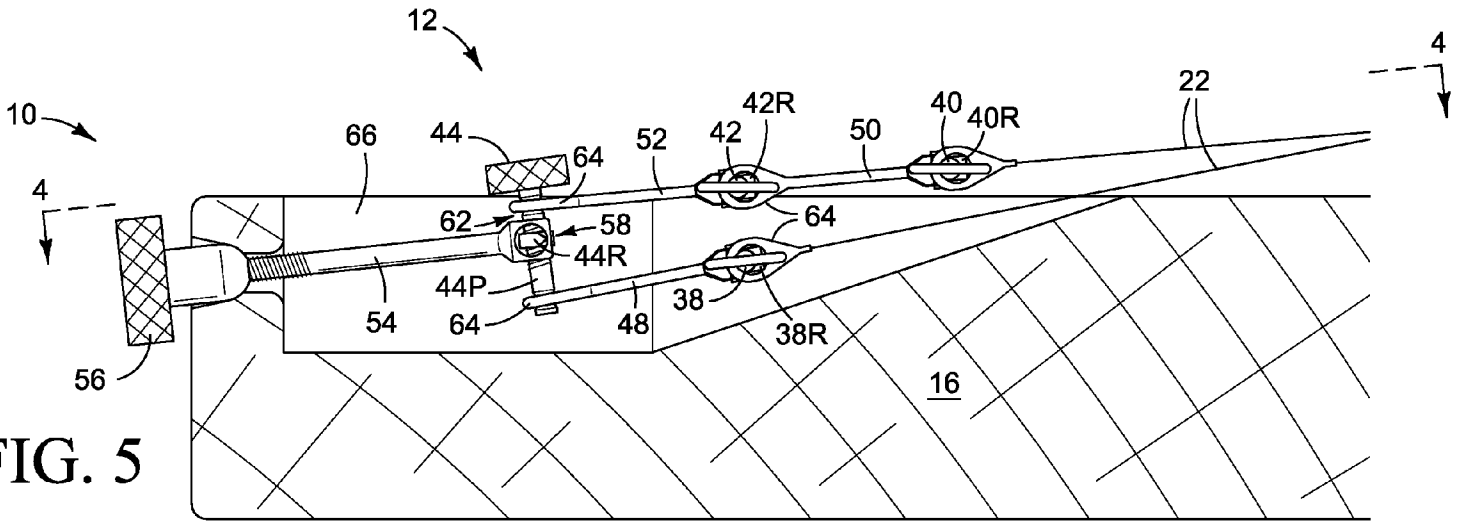

Referring now also to FIGS. 3-5, which are close-up views of tension equalizer 12, the end of each of the six strings 22 is secured to one of three paired-string levers 36, 38 and 40. As used in this document, "lever" means a rigid bar that pivots about a point of support, called the fulcrum, located between the places at which counteracting forces act or will act on the bar. (A lever such as this, in which the fulcrum is located between the places where counteracting forces act or will act on the bar, is commonly referred to as a first class lever.) Strings 22 are referred to individually as the low E, A, D, G, B and high E strings. Two of the three paired-string levers, levers 36 and 40, are linked to a secondary lever 42. The third paired-string lever, lever 38, and secondary lever 42 are linked to a primary lever 44. Primary lever 44 is anchored to guitar body 16. Paired-string levers 36 and 40 are linked to secondary lever 42 through connecting rods 46 and 50, respectively, or another suitable link. Paired-string lever 38 and secondary lever 42 are linked to primary lever 44 through connecting rods 48 and 52, respectively, or another suitable link. Primary lever 44 is anchored to guitar body 16 through a connecting rod 54, or another suitable link, and an adjusting nut 56.

Each paired-string lever 36, 38 and 40 is attached to a connecting rod 46, 48 and 50 with a point groove bearing 58 or another suitable link so that each lever 36, 38 and 40 pivots in a plane formed through the two strings secured to the lever. Secondary lever 42 is attached to connecting rod 52 with a point groove bearing 58 or another suitable link so that lever 42 pivots in a plane through connecting rods 46 and 50. Primary lever 44 is attached to connecting rod 54 with a point groove bearing 58 or another suitable link so that lever 44 pivots in a plane through connecting rods 48 and 52. Each link in tension equalizer 12, connecting rods 46-54 in the embodiment shown, is placed in tension when strings 22 are taut. Each lever 36-44, therefore, is supported at its fulcrum by the tension force in each respective link, connecting rods 46-54. That is to say, the levers are linked in tension when the strings are made taut. The links between the levers must be able to maintain tension but not compression. Hence, the links need not be rigid links.

In the embodiment shown, each lever 36, 38, 40, 42 and 44 is constructed as a threaded pin 36P, 38P, 40P, 42P and 44P that turns in a mating threaded receiver 36R, 38R, 40R, 42R and 44R that pivots in a bearing 58. Each threaded lever pin may be partially threaded (as shown) or fully threaded as necessary or desirable for the particular embodiment of the tension equalizer. While it is expected that a threaded pin/receiver may be used in many embodiments, any structural feature that allows the user to change the distance between the parts worked on by the lever and the fulcrum may be used for levers 36-44.

Preferably, each string 22 passes over bridge 24 on a ball bearing roller 60, as shown, to help reduce resistance to the movement of a string 22 lengthwise over bridge 24. The links between the strings and the levers, and between the levers and the connecting rods, are also configured to minimize friction in equalizer 12 to help ensure that the full measure of adjustment/equalization is delivered to the strings undiminished by friction forces. Any change in the tension force in one string used to overcome friction on its way to all of the other strings will detract from the tension equalizing function of equalizer 12. Hence, equalizer 12 will perform best to maintain the same relative tension among all strings 22 when a change in the tension in one string is transmitted to all of the other strings unimpeded by friction.

Figure 6:
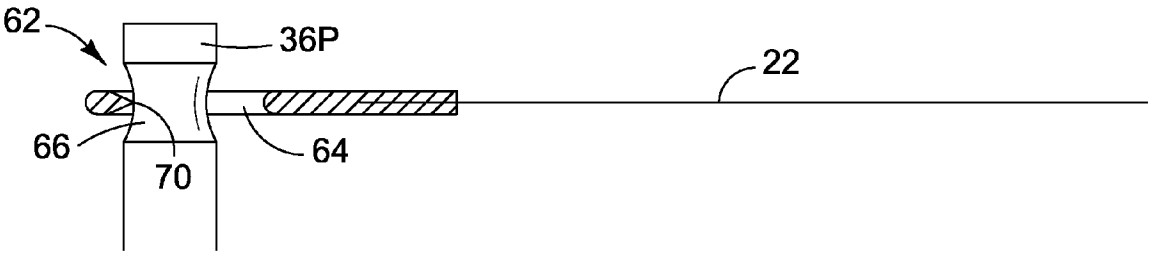
FIGS. 6 and 7 are detail partial section views showing a point groove bearing joining the strings and the paired string levers in the tension equalizer of FIGS. 3-5.
Figure 7:
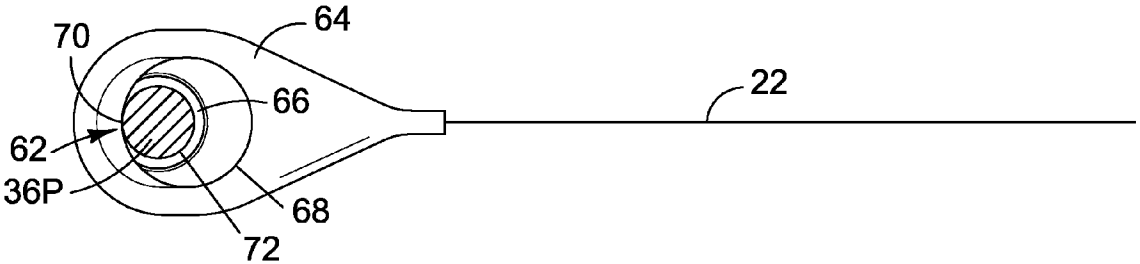
Figure 8:
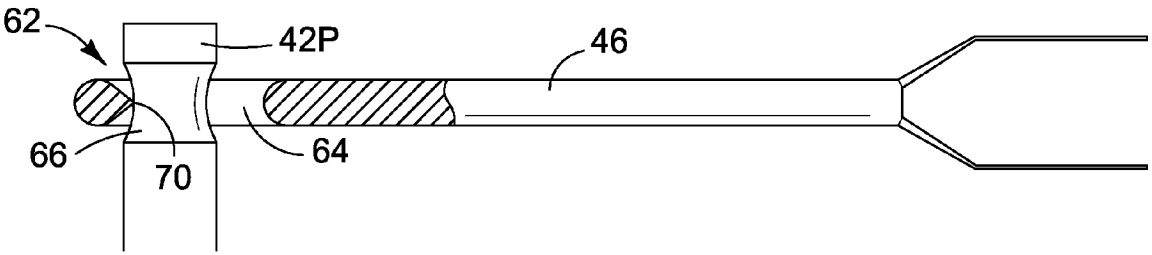
FIGS. 8 and 9 are detail partial section views showing a point groove bearing joining the connecting rods and the primary and secondary levers in the tension equalizer of FIGS. 3-5.
Figure 9:
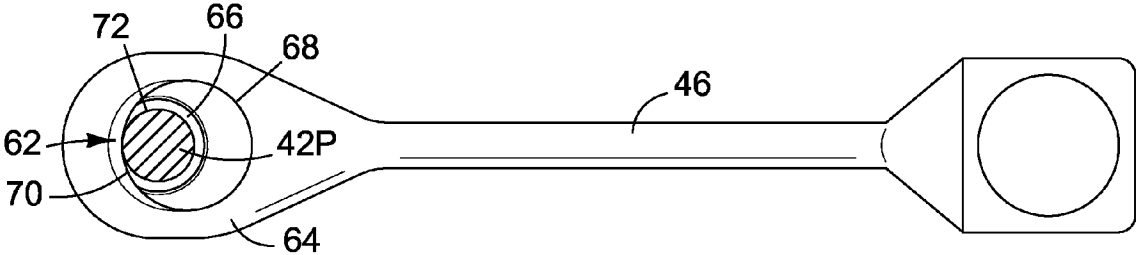
Figure 12:
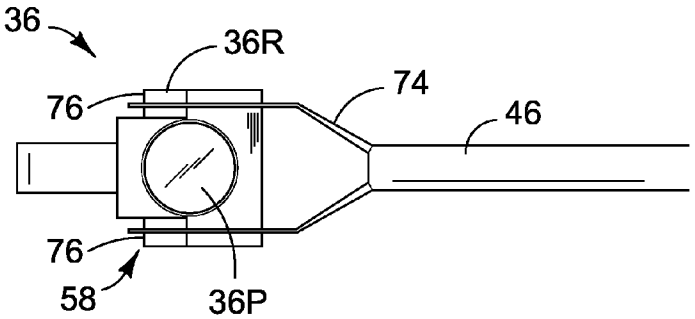
FIGS. 10-12 are detail plan, front elevation and side elevation views, respectively, showing an adjustable point groove bearing joining levers in the tension equalizer of FIGS. 3-5.
Figure 11:
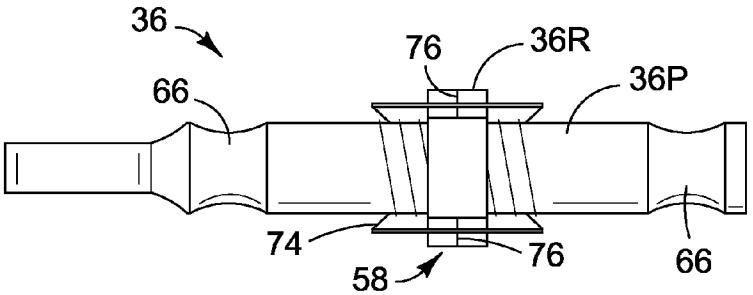
Figure 10:
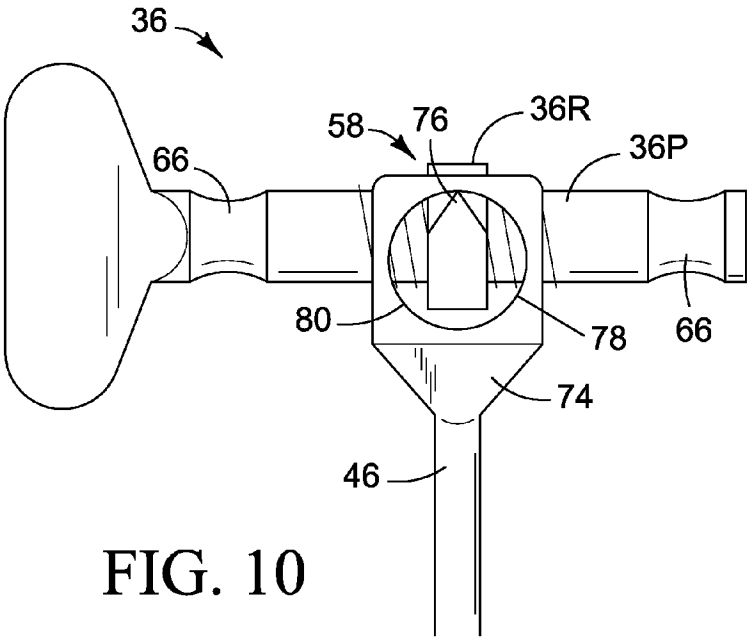

For example, the end of each string 22 is linked to a lever 36, 38 or 40, and the rearward end of each connecting rod 46, 48, 50 and 52 is linked a lever 42, 44, by what I have called a "point groove" bearing 62, which is shown in detail in the partial section views of FIGS. 6-7 (string to lever link) and FIGS. 8-9 (rod to lever link). Referring to FIGS. 6-9, point groove bearing 62 includes an eye 64 on the end of each string 22 and each rod 46-52 and a groove 66 on each pin 36P, 38P, 40P, 42P and 44P. Only pin 36P is shown in FIGS. 6 and 7. Only rod 46 and pin 42P are shown in FIGS. 8 and 9. The inside diameter 68 of eye 64 contacts groove 66 along an edge 70 formed on inside diameter 68. When viewed in section, as in FIGS. 6 and 8, eye 64 contacts groove 66 at a single point. This contact point becomes a line, as seen in FIGS. 7 and 9, whose length is determined by the relative size of the outside diameter 72 of pin 36P/42P at groove 66 and inside diameter 68 of eye 64. Similarly, the forward end of each connecting rod 46-54 is linked a lever 36-44 by a point groove bearing 58, which is shown in detail in FIGS. 10-12. Referring to FIGS. 10-12, each point groove bearing 58 includes a clevis-like piece 74 on the end of each connecting rod 46-54 and sharp edges 76 on each lever receiver 36R-44R. Only lever 36 and rod 46 are shown in FIGS. 10-12. The inside diameter 78 of each eye 80 on clevis piece 74 contacts an edge 76 on receiver 36R.

Each lever 36-44 supported on and pivoting at its respective fulcrum works to equalize the tension in the two parts on which the lever is working. As noted above, levers 36-44 will perform their equalizing work best when the tension forces in the strings are transmitted to the levers unimpeded by resistance at points of contact. As best seen in FIGS. 3 and 4, paired-string lever 36 equalizes the tension in the low E and D strings; paired-string lever 38 equalizes the tension in the A and B strings; paired-string lever 40 equalizes the tension in the G and high E strings; secondary lever 42 equalizes the tension in the low E/D string pair and the G/high E string pair (through connecting rods 46 and 50); and primary lever 44 equalizes the tension in low E/D and G/high E string quad and the A/B string pair (through connecting rods 48 and 52). If, for example, the tension in the low E string decreases, such as might be the case after a period of use, then the momentarily higher tension in the D string causes lever 36 to pivot counter-clockwise at its fulcrum until the tension in the two strings is again the same. The now momentarily higher tension in the G/high E string pair, in turn, causes secondary lever 42 to pivot counter-clockwise at its fulcrum until the tension in the low E/D and G/high E string pairs is again the same. The now momentarily higher tension in the A/B string pair, in turn, causes primary lever 44 to pivot counter-clockwise on its fulcrum until the tension in the low E/D and G/high E string quad and the A/B string pair is again the same. Of course, it is somewhat simplistic to describe the tension equalizing function of device 12 with respect to distinct, incremental changes in tension when, in fact, levers 36-44 are continually equalizing the tension among all the strings as the tension in any one of the strings changes.

The tension in all strings 22 may be adjusted by turning adjusting nut 56 to make connecting rod 54 longer or shorter and, correspondingly, to make all strings 22 longer and increase tension or to make all strings 22 shorter and decrease tension. In either case, the relative tension among strings 22 will not change. Tension equalizer 12 may be positioned in a recess 66 in guitar body 16, as shown in FIGS. 2-5, so that it will not obstruct playing the guitar and so that it is more easily hidden from view. As best seen in FIGS. 4 and 5, paired-string levers 36 and 40 and secondary lever 42, and their connecting rods 46, 50 and 52, may be lined up with one another in one plane and stacked laterally adjacent to paired-string lever 38 and its connecting rod 48 in another plane. The lengthwise axes of levers 36-42 are substantially parallel to one another. The lengthwise axis of primary lever 44 is then oriented substantially perpendicular to the other levers 36-42. (The axes of levers 36-42 may not be exactly parallel to one another because the axis of each lever 36-42 may not always be at the same angle relative to its respective connecting rod 46-52. Also, the axis of primary lever 44 may not be exactly perpendicular to the axes of the other levers 36-42 because it may not always be at the same angle relative to its connecting rod 54 and because strings 22 diverge at different angles from bridge 24.) This configuration allows the adjustment, relative to one another, of two strings not positioned on guitar 10 immediately next to each other. Also, in this configuration, strings 22 are held in the desired lateral spacing, congruous with the spacing of strings 22 from body 16 along neck 20 to headstock 18.

Figure 13:
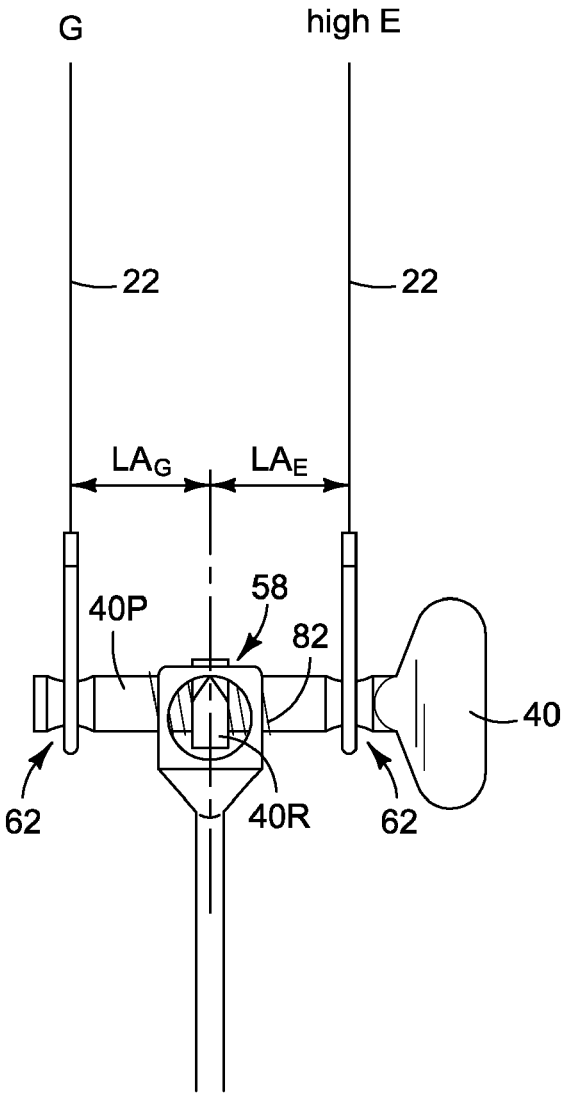
FIGS. 13 and 14 are detail views illustrating a tension equalizing lever from the tension equalizer shown in FIGS. 3-5 in different adjustment positions.
Figure 14:
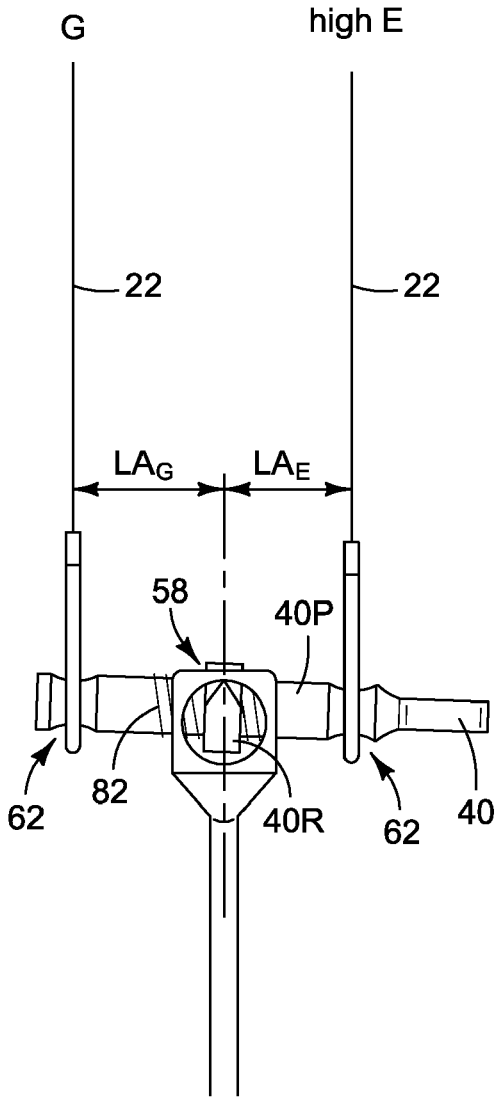

Strings 22 on guitar 10 may be tuned relative to one another by adjusting the position of the fulcrum of each lever 36-44 relative to the position of each part on which the lever works—that is to say, by changing the length of the moment arm through which the tension force in each part acts on the lever. In the embodiment shown, the position of the fulcrum on the lever is movable while the position of each part on the lever is fixed. In this embodiment, therefore, the position of the fulcrum is adjusted by moving the lever relative to the fulcrum, rather than by moving the strings (or other part on which the lever works) relative to the lever. FIGS. 13 and 14 are detail views illustrating paired string lever 40 in two different positions. Referring to FIGS. 13 and 14, the range of travel of lever 40 is determined by the length of threads 82 on lever pin 40P. In FIG. 13, lever 40 is positioned at the middle of its range of travel so that the lever arms $LA_G$ and $LA_E$ for strings G and high E are the same length. In FIG. 14, lever 40 is positioned at one end of its range of travel towards the high E string so that the lever arm $LA_G$ for the G string is longer than the lever arm $LA_E$ for the high E string.

In adjusting the G and high E strings from the position shown in FIG. 6 to the position shown in FIG. 7, in which the fulcrum for lever 40 is more toward the high E string, the tension in the G string will decrease and the tension in the high E string will increase, thereby lowering the tone of the G string relative to the tone of the high E string (i.e., raising the tone of the high E string relative to the tone of the G string). If it is desired to tune the G string higher relative to the high E string, then lever pin 40P is turned to move the fulcrum for lever 40 more towards the G string, thereby increasing the tension in the G string relative to the high E string.

Tuning strings 22 on guitar 10 proceeds by first adjusting the position of the fulcrum for each paired-string lever 36, 38 and 40 to achieve the desired tone for the low E and D strings, the A and B strings, and the G and high E strings; then adjusting the position of the fulcrum for secondary lever 42 to achieve the desired tone for the low E/D string pair and the G/high E string pair; and then adjusting the position of the fulcrum for the primary lever 44 to achieve the desired tone for the low E/D and G/high E string quad and the A/B string pair. When adjusting the position of the fulcrum for the secondary lever 42 or the primary lever 44, the desired tone may be determined by comparing just one string in each of the two parts on which the lever works. For example, for primary lever 44, turning lever pin 44P in receiver 44R until any one of the strings in the low E/D and G/high E string quad and any one of the strings in A/B string pair are in tune relative to one another will place all of the strings in tune relative to one another.

Changing the length of connecting rod 54 by turning adjusting nut 56 will adjust the overall tone of all strings 22 simultaneously higher or lower. Once strings 22 are in tune relative to one another, however, the tension equalizing effect of device 12 will tend to keep strings 22 in tune indefinitely, regardless of the overall tension in, and the corresponding overall tone of, strings 22. Tuning newly installed strings may be facilitated if, before proceeding with the tuning procedure described above, each lever pin 36P-44P is positioned at the middle of its range of travel in the corresponding receiver 36R-44R and the new strings are tightened using tuning heads 28 until each lever 36-44 is perpendicular to the corresponding connecting rod 46-54 (the position shown in FIG. 13).

The present invention has been shown and described with reference to the foregoing exemplary embodiments. It is to be understood, however, that other forms, details and embodiments may be made without departing from the spirit and scope of the invention which is defined in the following claims.

What is claimed is:

1. A device, comprising:

first, second, and third paired-strand levers each configured to receive a pair of tensile strands at locations spaced apart from one another along the paired-strand lever;

first, second, and third fulcrums each supporting a corresponding one of the paired-strand levers between the tensile strand receiving locations;

a fourth lever linked to the first and second paired-strand levers through the first and second fulcrums, respectively, at secondary lever link locations spaced apart from one another along the fourth lever;

a fourth fulcrum supporting the fourth lever between the secondary lever link locations;

a fifth lever linked to the third paired-string lever and the fourth lever through the third and fourth fulcrums, respectively, at primary lever link locations spaced apart from one another along the fifth lever;

a fifth fulcrum supporting the fifth lever between the primary lever link locations; and an anchor anchoring the fifth lever through an adjustable link to the fifth fulcrum to vary a distance between the anchor and the fifth lever.

2. The device of claim 1, wherein the levers and fulcrums are arranged relative to one another such that, when tensile strands are received by the first, second, and third paired-strand levers, the fourth lever is linked in tension to the first and second paired-strand levers through the first and second fulcrums, the fifth lever is linked in tension to the third paired-string lever and the fourth lever through the third and fourth fulcrums, and the fifth lever is anchored in tension to the anchor through the adjustable link.

3. The device of claim 2, wherein:

the fourth lever and its supporting fulcrum are movable with respect to one another to vary distances between the fulcrum and the secondary lever link locations; and the fifth lever and its supporting fulcrum are movable with respect to one another to vary distances between the fulcrum and the primary lever link locations.

4. The device of claim 1, wherein each paired-strand lever and its supporting fulcrum are movable with respect to one another to vary distances between the fulcrum and the tensile strand receiving locations.

5. A device, comprising:

first, second, and third paired-strand levers each configured to receive a pair of tensile strands at locations spaced apart from one another along the paired-strand lever;

first, second, and third fulcrums each supporting a corresponding one of the paired-strand levers between the tensile strand receiving locations;

a fourth lever linked to the first and second paired-strand levers through the first and second fulcrums, respectively, at secondary lever link locations spaced apart from one another along the fourth lever;

a fourth fulcrum supporting the fourth lever between the secondary lever link locations;

a fifth lever linked to the third paired-string lever and the fourth lever through the third and fourth fulcrums, respectively, at primary lever link locations spaced apart from one another along the fifth lever; and a fifth fulcrum supporting the fifth lever between the primary lever link locations; and wherein lengthwise axes of the first, second, third, and fourth levers are oriented substantially parallel to one another; and a lengthwise axis of the fifth lever is oriented substantially perpendicular to the lengthwise axis of each of the first, second, third, and fourth levers.

6. A device, comprising:

first, second, and third externally threaded pins each threaded through a corresponding first, second, and third internally threaded receiver, each pin configured to receive a pair of tensile strands at locations spaced apart from one another along the pin on opposite sides of the receiver;

a fourth externally threaded pin threaded through a corresponding internally threaded fourth receiver;

a first link linking the first receiver to the fourth pin at a location on one side of the fourth receiver, the first receiver pivotally connected to the first link;

a second link linking the second receiver to the fourth pin at a location on the other side of the fourth receiver opposite the first link, the second receiver pivotally connected to the second link;

a fifth externally threaded pin threaded through a fifth internally threaded receiver;

a third link linking the fourth receiver to the fifth pin at a location on one side of the fifth receiver, the fourth receiver pivotally connected to the third link;

a fourth link linking the third receiver to the fifth pin at a location on the other side of the fifth receiver opposite the third link, the third receiver pivotally connected to the fourth link;

an anchor anchoring the fifth receiver through an adjustable fifth link to vary a distance between the anchor and the fifth receiver; and wherein each of the first, second, and third pins and the corresponding first, second, and third receivers are movable with respect to one another by turning the pin to vary distances between the receiver and the tensile strand receiving locations, the fourth pin and the fourth receiver are movable with respect to one another by turning the fourth pin to vary distances between the fourth receiver and the first and second links, and the fifth pin and the fifth receiver are movable with respect to one another by turning the fifth pin receiver to vary distances between the fifth receiver and the third and fourth links.

7. The device of claim 6, wherein the pins and links are arranged relative to one another such that, when tensile strands are received by the first, second, and third pins, the fourth pin is linked in tension to the first and second paired-strand pins through the first and second receivers, the fifth pin is linked in tension to the third paired-string pin and the fourth pin through the third and fourth receivers, and the fifth pin is anchored in tension to the anchor through the adjustable fifth link.

8. The device of claim 6, wherein:

lengthwise axes of the first, second, third, and fourth pins are oriented substantially parallel to one another; and a lengthwise axis of the fifth pin is oriented substantially perpendicular to the lengthwise axis of each of the first, second, third, and fourth pins.

9. The device of claim 6, wherein each of the first, second, fourth and third receivers are pivotally connected to the first, second, third and fourth links, respectively, through a first bearing that includes an inner part of each eye of a clevis-like piece on one end of the link contacting an edge on the receiver.

10. The device of claim 9, wherein each of the first and second links are connected to the fourth pin, and each of the third and fourth links are connected to the fifth pin, through a second bearing that includes an edge on an inner part of an eye on one end of the link contacting a groove in the receiver.

11. A device, comprising:

a plurality of tensile strands stretched between a first anchor and a second anchor, the first anchor and the second anchor being stationary with respect to one another;

first, second, and third paired-strand levers, a pair of the tensile strands attached to each of the paired-strand levers at locations spaced apart from one another along the paired-strand lever;

first, second, and third fulcrums each supporting a corresponding one of the paired-strand levers at a location between the tensile strands;

a fourth lever linked in tension to the first and second paired-strand levers through the first and second fulcrums, respectively, at secondary lever link locations spaced apart from one another along the fourth lever;

a fourth fulcrum supporting the fourth lever between the secondary lever link locations;

a fifth lever linked in tension to the third paired-string lever and the fourth lever through the third and fourth fulcrums, respectively, at primary lever link locations spaced apart from one another along the fifth lever;

a fifth fulcrum supporting the fifth lever between the primary lever link locations; and the second anchor anchoring the fifth lever in tension through an adjustable link to the fifth fulcrum to vary a distance between the second anchor and the fifth lever.

12. The device of claim 11, wherein:

each paired-strand lever and its supporting fulcrum are movable with respect to one another to vary distances between the fulcrum and the tensile strand receiving locations;

the fourth lever and its supporting fulcrum are movable with respect to one another to vary distances between the fulcrum and the secondary lever link locations; and the fifth lever and its supporting fulcrum are movable with respect to one another to vary distances between the fulcrum and the primary lever link locations.

13. The device of claim 11, wherein:

lengthwise axes of the first, second, third, and fourth levers are oriented substantially parallel to one another; and a lengthwise axis of the fifth lever is oriented substantially perpendicular to the lengthwise axis of each of the first, second, third, and fourth levers.

14. The device of claim 11, wherein each lever comprises an externally threaded pin and each fulcrum comprises an internally threaded receiver, each pin being threaded through a corresponding receiver.

15. The device of claim 11, wherein each tensile strand is attached to a lever through a bearing that includes an edge on an inner part of an eye on one end of the tensile strand contacting a groove in the lever.

* * * * *